US007059543B2

(12) United States Patent
Dushkin et al.

(10) Patent No.: US 7,059,543 B2
(45) Date of Patent: Jun. 13, 2006

(54) LIQUID SPRAYERS

(76) Inventors: Andrey L. Dushkin, ul. Scherbakovskaya, d. 54, kv. 191, 105187 Moscow (RU); Alexander V. Karpyshev, Olimpiiski prospekt, d. 28, kv. 435, 129272 Moscow (RU)

( * ) Notice: Subject to any disclaimer, the term of this patent is extended or adjusted under 35 U.S.C. 154(b) by 106 days.

(21) Appl. No.: 10/472,278

(22) PCT Filed: Mar. 21, 2002

(86) PCT No.: PCT/RU02/00108

§ 371 (c)(1),
(2), (4) Date: Sep. 22, 2003

(87) PCT Pub. No.: WO02/076624

PCT Pub. Date: Oct. 3, 2002

(65) Prior Publication Data

US 2004/0124269 A1 Jul. 1, 2004

(30) Foreign Application Priority Data

Mar. 22, 2001 (RU) ..... 2001107433

(51) Int. Cl.
*A62C 31/02* (2006.01)

(52) U.S. Cl. ..... 239/390; 239/428.5; 239/590; 239/590.3; 239/590.5; 239/553; 239/553.3

(58) Field of Classification Search ..... 239/428.5, 239/590, 590.3, 590.5, 553, 553.3
See application file for complete search history.

(56) References Cited

U.S. PATENT DOCUMENTS

| | | | | |
|---|---|---|---|---|
| 2,879,003 | A * | 3/1959 | Finn | 239/434.5 |
| 3,701,482 | A * | 10/1972 | Sachnik | 239/590.3 |
| 4,134,547 | A | 1/1979 | Gamst | |
| 4,341,347 | A | 7/1982 | DeVittorio | |
| 4,644,974 | A * | 2/1987 | Zingg | 138/44 |
| 4,801,090 | A * | 1/1989 | Yoshida et al. | 239/290 |
| 5,113,945 | A * | 5/1992 | Cable | 169/15 |
| 5,431,346 | A * | 7/1995 | Sinaisky | 239/399 |
| 5,662,605 | A * | 9/1997 | Hurwitz | 604/514 |
| 5,693,226 | A * | 12/1997 | Kool | 210/541 |
| 5,975,996 | A * | 11/1999 | Settles | 451/102 |
| 6,042,089 | A * | 3/2000 | Klein | 261/76 |
| 6,491,097 | B1 * | 12/2002 | Oneal et al. | 166/278 |

FOREIGN PATENT DOCUMENTS

| | | | |
|---|---|---|---|
| DE | 36 22 292 | A1 | 1/1987 |
| DE | 3622292 | A1 * | 1/1987 |
| RU | 2123871 | C1 * | 12/1998 |
| SU | 994022 | A * | 2/1983 |

* cited by examiner

*Primary Examiner*—David A. Scherbel
*Assistant Examiner*—James S. Hogan
(74) *Attorney, Agent, or Firm*—Rothwell, Figg, Ernst & Manbeck, PC

(57) ABSTRACT

A liquid sprayer includes a casing (1) having a flow-through channel composed of sequentially joined inlet portion (2) formed as a converging tube, a cylindrical portion (3) and an outlet portion (4) formed as a conical diffuser. A length of cylindrical portion (3) is not less than a radius thereof. A cone angle of the diffuser forming the outlet portion (4) of the flow-through channel is greater than a cone angle of the converging tube forming the inlet portion (2) of the same channel. Alternatively, the converging tube forming the inlet portion of the flow-through channel is made conoid-shaped. Implementation of the liquid sprayer allows steady-state fine-dispersed liquid flow to be generated at the minimal energy consumption.

26 Claims, 3 Drawing Sheets

LIQUID SPRAYERS

FIELD OF THE INVENTION

The invention relates to the liquid spraying technique and may be used in fire-prevention systems, as part of processing equipment, for the burning of fuels in the heat engineering and transport, as well as for humidifying the environment and for spraying disinfectants and insecticides.

BACKGROUND OF THE INVENTION

Diversified types of liquid sprayers are currently used in a variety of fields, including the fire-fighting equipment, as fire-extinguishant sprayers.

As an example, the U.S. Pat. No 5,125,582 (IPC B05B 1/00, published 30.06.1992) discloses the construction of a liquid sprayer designed for the generation of cavitation liquid flows. The prior art comprises a casing with a flow-through channel formed by a nozzle and a cylindrical chamber. The nozzle is made in the form of a converging tube communicated with a conical diffuser without continuous joining of their surfaces. A length of the cylindrical chamber is at least three diameters of a minimal section of the nozzle. On supplying the liquid under pressure into the inlet opening of the converging tube of the nozzle, the liquid flow section is contracted and the outflow velocity is increased. An abrupt expansion of the liquid flow in the diffuser results in liquid cavitation. The liquid cavitation is intensified in the process of passage of the liquid jet through the cylindrical chamber, where the liquid jet is expanded and return vortex flows are generated. An annular vacuum zone is formed around a conical jet to initiate a cavitation process and an associated liquid flow dispersion process.

However, despite the possibility of an intensified cavitation process, the prior art liquid sprayer does not provide for the formation of a steady-state fine-dispersed liquid flow, that can retain its shape and section size at the distances of up to 10 m, which is of particular importance when the sprayer is employed for suppressing the sources of fire.

A vacuum-type sprayer head (the author's certificate, USSR, No 994022, IPC B05B 1/00, published 07.02.1983) is also known, which comprises a nozzle composed of a converging tube and a cylindrical head located coaxial with the nozzle. The cylindrical head is equipped with ejection holes formed at the side of its outlet opening to admit atmospheric air into a vacuum zone in the cylindrical head cavity. As a result the incoming air saturates the moving liquid flow to provide for splitting of the flow into small droplets.

Russian Patent No 2123871 (IPC A62C 31/02, published 27.12.1998) describes a head for forming an aerosol-type water spray, which allows the dispersion of a gas-drop jet to be improved. The prior art sprayer (head) comprises a casing having a flow-through channel formed as a Laval nozzle, an inlet pipe union for supplying liquid under pressure, and a distributing grid located between the pipe union and an inlet section of the Laval nozzle. The sizes of the distributing grid holes are 0.3÷1.0 the diameter of the Laval nozzle critical section. While passing through the holes of the distributing grid, the liquid flow is split into separate streams, which are sequentially concentrated in the nozzle orifice and accelerated to high velocities. Such embodiment provides for a sufficient distance of discharging a fire extinguishant and fine spraying.

The closest analog for the claimed versions of the sprayer is a liquid spraying device described in the Patent DDR No. 233490 (IPC A62C 1/00, published 05.03.1986), which is adapted for feeding a fire-extinguishant to a source of fire. The device is composed of a casing involving a flow-through channel, into which a working fluid, including water, is supplied under pressure. The flow-through channel of the device is composed of an inlet portion formed as a converging tube, a cylindrical portion and an outlet portion formed as a conical diffuser, said portions being sequentially joined with one another in axially aligned relationship. Also, the device comprises a reservoir containing a fire-extinguishant, which is communicated with the diffuser via radial passages.

During operation of said device the liquid (water) is supplied under the pressure of 1.5–2.0 bar into the inlet opening of the flow-through channel and is sequentially accelerated in a nozzle formed by the converging tube, the cylindrical portion and the diffuser. The fire-extinguishant is ejected into the diffuser through the radial passages to be further intermixed with the liquid flow. The implementation of said device allows the reach of the fire-extinguishant to be essentially increased to thereby improve the fire-fighting effectiveness, when know extinguishants are utilized. However, the given embodiment does not provide for the generation of high-velocity fine-dispersed gas-drop jets. The liquid flow is used in such devices for the most part as a carrier for an additionally introduced fire-extinguishant, for example, for foam-generating additives.

DISCLOSURE OF THE INVENTION

The claimed invention is aimed at generating a steady-state fine-dispersed liquid spray, which must retain the shape and size of its section at the distances of up to 10 m, and at increasing the efficiency of energy consumed for the generation of a gas-drop jet. Also the distribution of drop concentration over the section of a fine-dispersed gas-drop jet must be homogeneous. The solution of the aforesaid objectives is of particular importance in the implementation of liquid sprayers for suppressing the sources of fire.

The technical result which may be achieved through the solution of the tasks set forth consists in increasing the fire-fighting effectiveness, when water containing fire-extinguishing additives is used, in increasing the effective utilization of a working fluid and in reducing the energy consumption for generating a gas-drop jet.

The aforesaid objectives are achieved by providing a liquid sprayer according to the first embodiment of the invention comprising a casing having a flow-through channel composed of an inlet portion formed as a converging tube, a cylindrical portion and an outlet portion formed as a conical diffuser, with said portions being sequentially joined with one another in axially aligned relationship, wherein, according to the present invention, a length of the cylindrical portion is not less than its radius, a cone angle of the diffuser defining the outlet portion of the flow-through channel is greater than a cone angle of the converging tube defining the inlet portion of the flow-through channel.

A liquid sprayer having an apex angle of a cone defining the converging tube between 6° and 20° and an apex angle of a cone defining the diffuser between 8° and 90° is preferably used. In particular, an apex angle of a cone defining the converging tube may be equal to 13° and an apex angle of a cone defining the diffuser may be equal to 20°.

To enhance the steady-state flow of the gas-drop jet so that it is free from stationary and oscillatory deviations from a predetermined orientation, inlet edges of the converging tube defining the inlet portion of the flow-through channel and outlet edges of the diffuser defining the outlet portion of the flow-through channel are formed rounded.

The radius of rounded edges is substantially 1–2.5 the radius of the cylindrical portion of the flow-through channel.

The liquid sprayer may be equipped with a chamber having cylindrical channel, whose inlet end is joined with an outlet section of the diffuser, with the diameter of the cylindrical channel of the chamber being not less than the diameter of the outlet section of the diffuser. The utilization of aforesaid chamber allows fine-spray find-dispersed gas-drop just to be generated at the minimal consumption of energy. A diameter of said cylindrical channel of the chamber is substantially 4–6 diameters of the cylindrical portion of the flow-through channel, and length of said channel is 10–30 diameters of the cylindrical portion of the flow-through channel.

A grid or perforated plate may be located at the outlet section of the cylindrical channel of said chamber. In this event, the gas-drop jet generated in the cylindrical channel of the chamber is additionally split.

In order to reduce the losses of energy in the process of generating a fine-dispersed flow, a total cross-sectional area of the perforated plate or grid holes is selected to be 0.4–0.7 of a cross-sectional area of the cylindrical channel of said chamber.

The chamber wall may be furnished with at least one tangential opening for ejecting gas (for example, air) from the outside into the cylindrical channel of said chamber. Such embodiment allows the gas-drop jet to be stabilized and the losses of kinetic energy of liquid droplets to be reduced due to the swirling of the air flow around the jet generated. With this aim in view, the chamber wall of the preferred embodiment may be equipped with at least four tangential openings, which are symmetrically arranged by pairs in two cross-sectional planes of the cylindrical channel of said chamber, the first plane extending near the diffuser outlet section and the second plane extending near the outlet section of the chamber.

According to another preferred embodiment, a liquid sprayer may be comprised of a chamber arranged coaxial with a casing, on the outside thereof. At least one passage is formed between the casing outer surface and the chamber inner surface for supplying a gas flow under pressure toward the outlet section of the outlet portion of the flow-through channel of said sprayer. The chamber may contain a nozzle composed of a converging tube and a diffuser arranged in sequence. The nozzle inlet section is communicating with an outlet portion of the flow-through channel of said sprayer. The use of the chamber with the nozzle allows the energy of a cocurrent gas flow to be utilized for further splitting of liquid drops and for increasing the reach of the fine-dispersed gas-drop jet.

The accomplishment of said objectives is also enabled by providing a liquid sprayer which according to the second embodiment of the invention includes a casing having a flow-through channel composed of an inlet portion formed as a converging tube, a cylindrical portion and an outlet portion formed as a conical diffuser, with said portions being joined with one another in axially aligned relationship, wherein according to the present invention a length of the cylindrical portion is not less that a radius thereof, and the converging tube defining the inlet portion of the flow-through channel is made conoid-shaped, with a radius of roundness of the side surface being not less than a radius of the cylindrical portion of the flow-through channel.

The apex angle of a cone forming the diffuser is preferably between 8° and 90°.The surface of the conoid-shaped converging tube is joined with the surface of the cylindrical portion of the flow-through channel preferably at an angle of not more than 2°.

To further stabilize the steady-state flow of a gas-drop flow, outlet edges of the diffuser defining the outlet portion of the flow-through channel are made rounded. The radius of roundness of the edges is substantially 1–2 the radius of the cylindrical portion of the flow-through channel.

The liquid sprayer may be furnished with a chamber having a cylindrical channel, whose inlet end is joined with an outlet section of the diffuser, a diameter of the cylindrical channel of the chamber being not less than a diameter of the outlet section of the diffuser. The utilization of said chamber, as in the first embodiment of the invention, allows fine-spray fine-dispersed gas-drop jets to be generated at the minimal energy consumption. A diameter of the cylindrical channel of the chamber is substantially 4–6 diameters of the cylindrical portion of the flow-through channel, and its length is 10–30 diameters of the cylindrical portion of the flow-through channel.

A grid or perforated plate may be located in the outlet section of the cylindrical channel of the chamber, as in the first embodiment of the invention. In order to reduce the losses of energy during generation of fine-dispersed flow, the total cross-sectional area of the perforated plate or grid holes is selected to be equal to 0.4–0.7 the cross-sectional area of the cylindrical channel of said chamber.

The chamber wall, as in the first embodiment of the invention, may be furnished with at least one tangential opening for ejecting gas from the outside into the cylindrical channel of the chamber. Such embodiment allows the gas-drop jet to be stabilized and the losses of kinetic energy of liquid flows to be reduced due to swirling of the air flow around the flow generated. With this aim in view, the chamber wall in the preferred embodiment of the invention may be equipped with at least four tangential openings, which are symmetrically arranged by pairs in two cross-sectional planes of the cylindrical channel of said chamber, the first plane extending near the outlet section of the diffuser and the second plane extending near the outlet section of said chamber.

Also the preferred embodiment of the liquid sprayer may contain a chamber arranged coaxial with the casing on the outside thereof instead of the above described chamber. At least one passage is formed between the outer surface of the casing and the inner surface of the chamber for supplying gas under pressure to the section of the outlet portion of the flow-through channel of said sprayer. The chamber may comprise a nozzle composed of a converging tube and a diffuser arranged in sequence. The nozzle inlet section is communicating with the outlet portion of the flow-through channel of said sprayer. The implementation of the chamber with the nozzle allows, as in the first embodiment of the invention, the energy of a cocurrent gas flow to be utilized for further splitting of liquid droplets and increasing the reach of the fine-dispersed gas-drop flow.

BRIEF DESCRIPTION OF THE DRAWINGS

The invention is explained by the examples of a particular embodiment and by the applied drawings describing the following.

PREFERRED EXAMPLES OF EMBODIMENTS OF THE INVENTION

Figure 1:
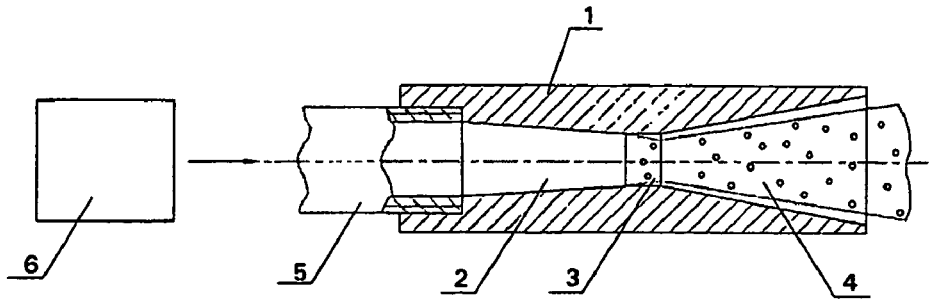
FIG. 1 is a schematic representation of the liquid sprayer formed in accordance with the first embodiment of the invention.

A liquid sprayer formed according to the first embodiment of the invention (See FIGS. 1 to 5) comprises a casing 1 with a flow-through channel composed of axially aligned portions joined with one another. An inlet portion 2 is made in the form of a converging tube with an outlet opening joined to an inlet opening of a cylindrical portion 3. An outlet portion 4 made in the form of a conical diffuser comprises an inlet opening joined with an outlet opening of the cylindrical portion 3. A length of the cylindrical portion is 0.7 the diameter thereof. An apex angle of a cone defining the converging tube is 13° and an apex angle of a cone defining the diffuser is 20°.

The casing 1 is connected at the side of the inlet opening of the converging tube to a pipe union 5 of a pipeline of a liquid supply system. The liquid supply system includes a pump- or pressure-type liquid supercharger 6.

In a preferred embodiment (See FIG. 2) inlet edges of the converging tube defining the inlet portion 2 of the flow-through channel and outlet edges of the diffuser defining the outlet portion 4 are made rounded, with the radius of roundness being equal to the diameter of the cylindrical portion 3.

The liquid sprayer may include a chamber 7 (See FIG. 3) having a cylindrical channel 8 whose inlet opening is communicating with an outlet section of the diffuser (outlet portion 4). A diameter of the cylindrical channel 8 is equal to four diameters of the cylindrical portion 3 of the flow-through channel. The length of the cylindrical channel 8 measured from the outlet section of the diffuser to the outlet section of the chamber 7 is equal to ten diameters of the cylindrical portion 3 of the flow-through channel. A perforated plate 9 is located in the outlet opening of the cylindrical channel 8 and attached to an end part of the chamber 7 by means of a special nut 10. A total cross-sectional area of holes in the perforated plate 9 is 0.5 the cross-sectional area of the cylindrical channel 8. The maximal size "d" of each of the flow-through holes in the perforated plate 9 is selected depending on the diameter "D" of the cylindrical portion 3 in accordance with the condition: $0.2<d/D<0.7$.

Figure 3:
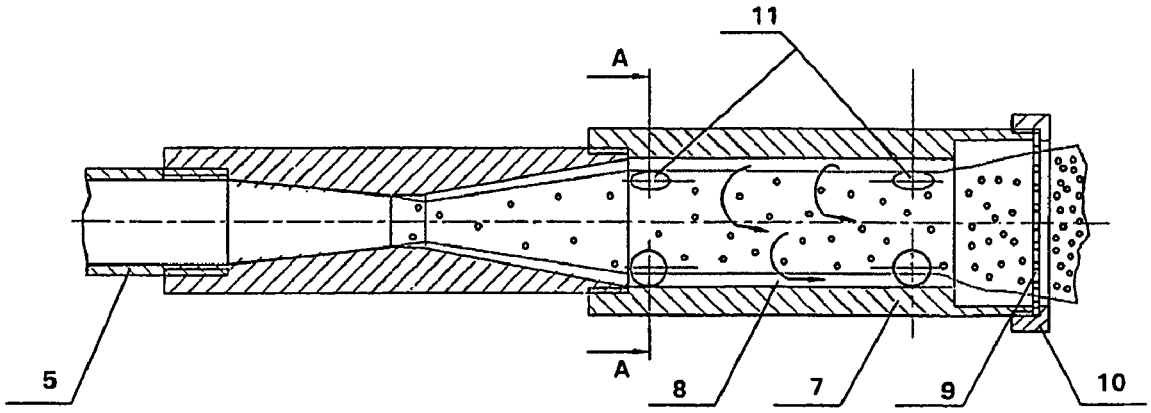
FIG. 3 is a schematic sectional view of the liquid sprayer formed in accordance with the first embodiment of the invention with a chamber having a cylindrical channel.
Figure 4:
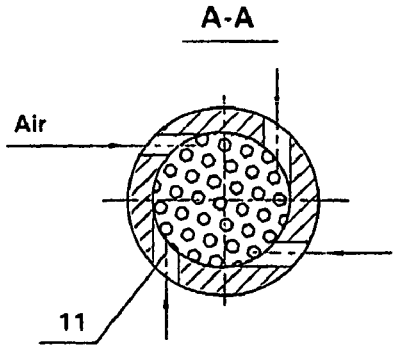
FIG. 4 is a sectional view in the plane A—A of the chamber equipped with a cylindrical channel and used in two embodiments of the invention (See FIGS. 3 and 6)
Figure 5:
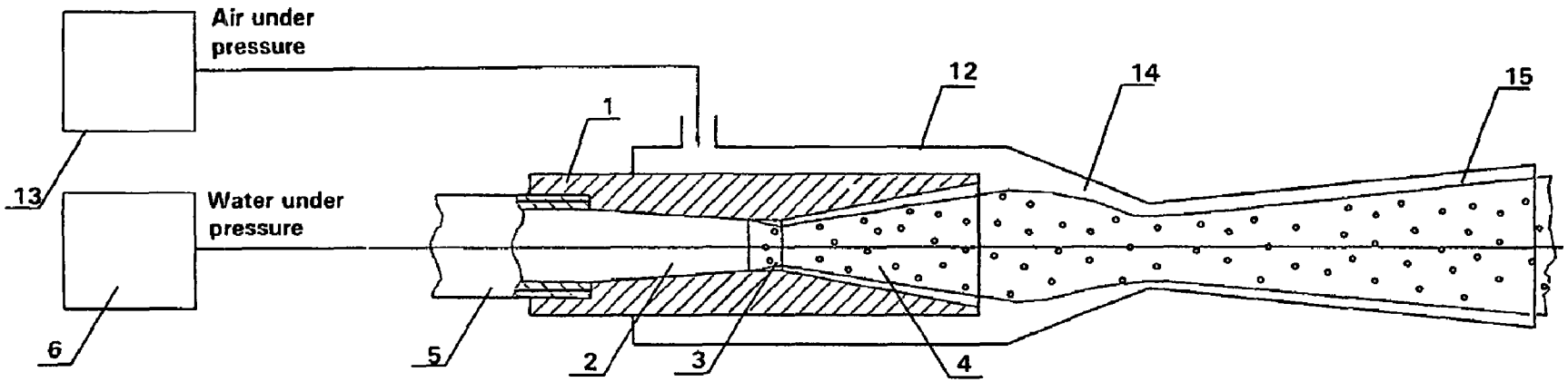
FIG. 5 is a schematic sectional view of the liquid sprayer formed in accordance with the first embodiment of the invention with the chamber located coaxial with a casing so that an annual passage is formed.

Eight tangential openings 11 are formed in the wall of chamber 7 for ejecting air from the outside into the cylindrical channel 8 (See FIGS. 3 and 4). The tangential openings 11 are arranged in two cross-sectional planes of the cylindrical channel 8. Four openings 11 are symmetrically arranged in the cross-sectional plane of the channel 8 near the outlet section of the diffuser (outlet portion 4), and four other openings 11 are arranged in the cross-sectional plane of the channel 8 near the outlet section of the chamber 7.

The sprayer may be equipped with a cylindrical chamber 12 (See FIG. 5) arranged in axial alignment with the casing 1, on the outside thereof. An annular passage is formed between the outer surface of the casing 1 and the inner surface of the chamber 12 and communicated with a high-pressure gas source 13. The annular passage is adapted for supplying gas to the section of the outlet portion 4 of the flow-through channel. A nozzle located on an end part of the chamber is composed of a converging tube 14 and a diffuser 15.

Figure 6:
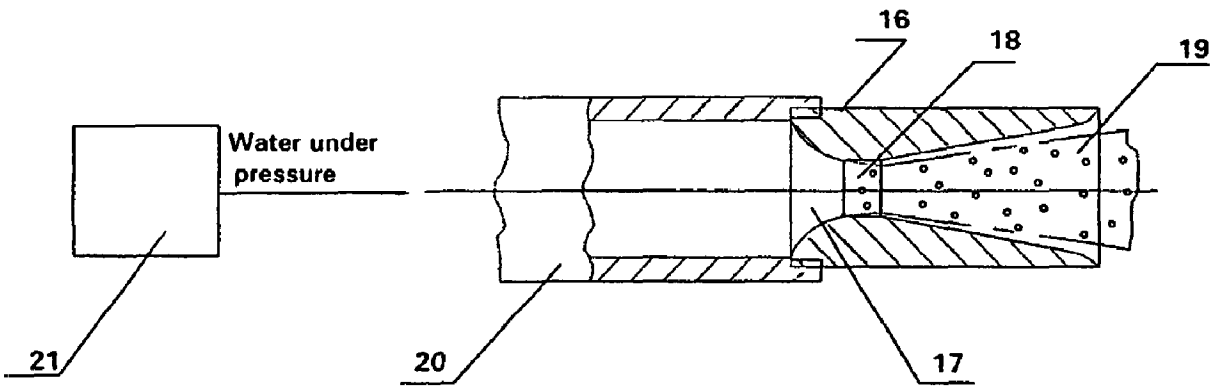
FIG. 6 is a schematic representation of the liquid sprayer formed in accordance with the second embodiment of the invention.

A liquid sprayer, according to the second embodiment of the invention (See FIGS. 6 to 8), comprises a casing 16 with a flow-through channel composed of sequentially joined portions axially aligned with one another. An inlet portion 17 is made in the form of a conoid-shaped converging tube with a radius of roundness of a side surface equal to the diameter of a cylindrical portion 18. A length of the cylindrical portion 18 joined with the inlet portion 17 is 0.7 the diameter thereof. An outlet portion 19 formed as a conical diffuser has an inlet opening joined with the outlet opening of the cylindrical portion 18. An apex angle of a cone forming the diffuser is 20°. The conoid-shaped surface of the converging tube (inlet portion 17) is joined with the surface of the cylindrical portion 18 at an angle of 2°. The outlet edges of the diffuser forming the outlet portion 19 of the flow-through channel are made rounded, with a radius of roundness of the edges being equal to that of the cylindrical portion 18.

The casing 16 is connected to a pipe union 20 of a pipeline of a liquid supply system including a liquid supercharger 21.

The outlet edges of the diffuser forming the outlet portion 19 are made rounded, with a radius of the roundness of the edges being equal to that of the cylindrical portion 18.

In the preferred embodiment of the sprayer (See FIG. 7) the outlet opening of the diffuser (outlet portion 19) is communicated with a chamber 22 having a cylindrical channel 23. Geometrical sizes of the cylindrical portion 18 are selected identical to those of the first embodiment of the sprayer (See FIG. 3). A perforated plate 24 is located in the outlet opening of the cylindrical channel 23 and attached to an end part of the chamber 22 by means of a special nut 25. The sizes of holes in the perforated plate 24 are selected identical to those of the first embodiment of the sprayer (See FIG. 3).

Figure 7:
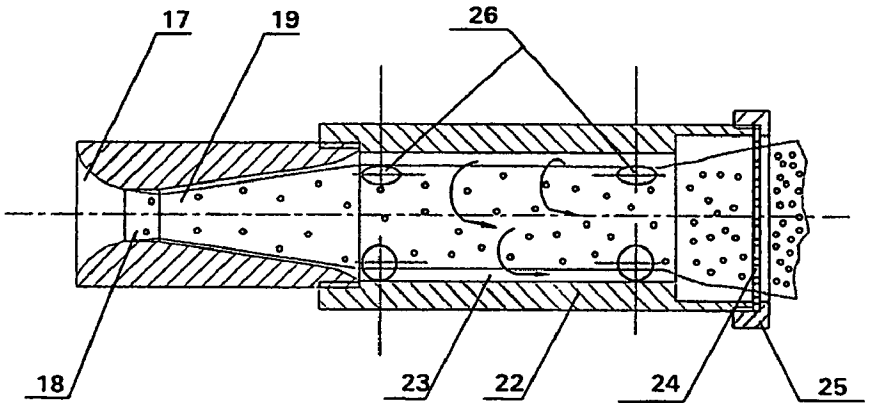
FIG. 7 is a schematic sectional view of the liquid sprayer equipped in accordance with the second embodiment of the invention with a chamber having a cylindrical channel.
Figure 8:
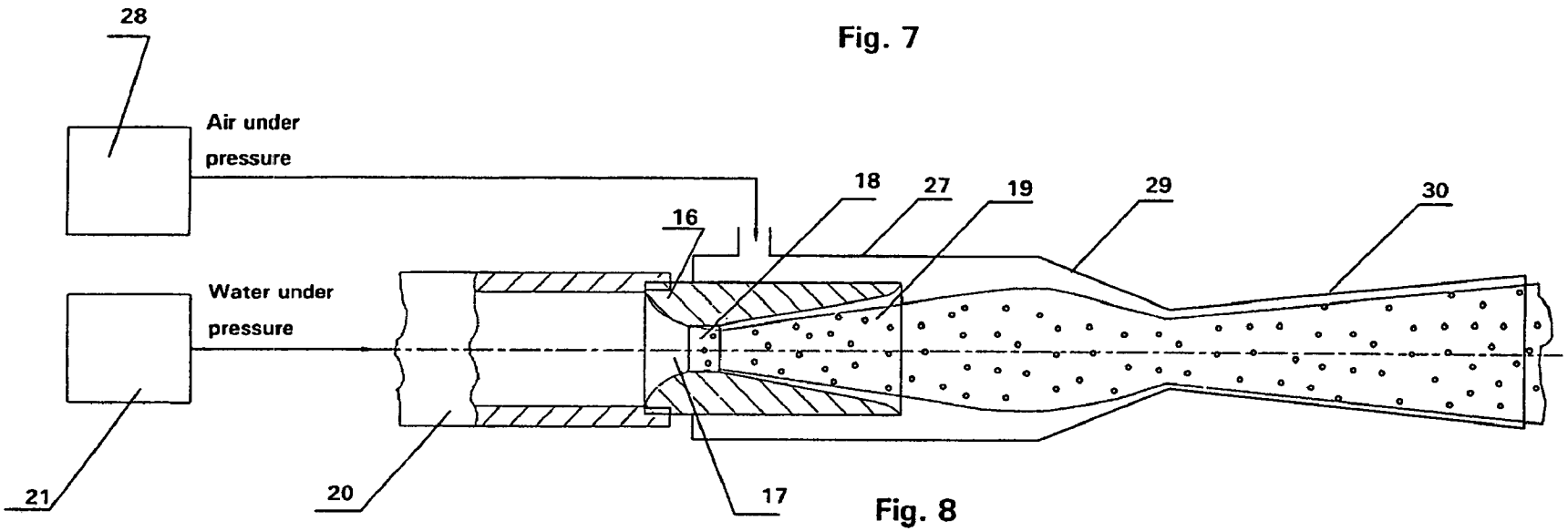
FIG. 8 is a schematic sectional view of the liquid sprayer equipped in accordance with first embodiment of the invention with a chamber arranged coaxial with a casing so that an annular passage is formed.

Eight tangential openings 26 are formed in the wall of the chamber 22 for ejecting air from the outside into the cylindrical channel 23 (See FIGS. 7 and 4). Tangential openings 26 are arranged and oriented in the manner identical to that of the first embodiment of the sprayer.

Another example of the sprayer according to the second embodiment of the invention may comprise a cylindrical chamber 27 (See FIG. 8) arranged coaxial with the casing 16, on the outside thereof. An annular passage formed between the outer surface of the casing and the inner surface of the chamber 27 is communicated with a high-pressure gas source 28. The annular passage is adapted for supplying a cocurrent gas flow to the outlet section of the outlet portion 19 of the flow-through channel. A nozzle on the end part of the chamber is composed of a converging tube 29 and a diffuser 30.

The operation of the sprayer designed in accordance with the first embodiment of the invention is carried out in the following manner.

Water is supplied under pressure by a supercharger 6 via a pipeline of a water supply system to a pipe union 5 connected to an outlet opening of the casing 1 of said sprayer. Water is delivered into an inlet opening of the converging tube (inlet portion 2), where a high-velocity liquid flow is generated with a uniform velocity profile over the section thereof. The liquid flow is advancing in the converging tube from the zone with a higher static pressure and a lower dynamic pressure to the zone with a lower static pressure and a higher dynamic pressure. This allows the conditions for the formation of vortex flows and separation of the liquid flow from the channel wall to be prevented.

The maximal liquid flow velocity at the outlet end of the converging tube is selected such that the static pressure at the outlet end of the converging tube is decreased to the value of the saturated liquid vapor pressure at the initial temperature (for water $P_{sv} \approx 2.34 \cdot 10^{-3}$ MPa at t=20° C.). The initial static water pressure upstream of the converging tube is maintained at the level not below the critical pressure sufficient for the development of cavitation during outflow into the atmosphere ($P_{in} \approx 0.23$ MPa). The losses of kinetic energy occurring during passage of the liquid flow through the converging tube depend on the cone angle of a cone forming the conical surface of the converging tube. As the cone angle increases from 6°, the consumption of energy is initially increased to reach the maximal value at the angle of ~13° and is then decreased at the angle of ~20°. The optimal apex angle of the cone forming the converging tube is therefore selected between 6° and 20°.

Upon passage through the inlet portion 2 of the flow-through channel of the sprayer, the liquid flow is delivered into the cylindrical portion 3, where cavitation bubbles are developed for the period of time of $\sim 10^{-4}$–$10^{-5}$ s. The formation of bubbles during the passage of water flow through the cylindrical portion 3 is ensured in case the length of the cylindrical portion exceeds its radius to provide for predetermined time sufficient for the steady-state cavitation.

During passage of the liquid through the outlet portion 4 formed as a diffuser the cavitation bubbles are intensively growing and clapping and the liquid flow is separated from the diffuser wall. The flow is accelerated in the diffuser due to the reduction in the density of the liquid flow containing vapor and air bubbles. Because the static pressure in an inlet zone of the diffuser is low and is comparable to the cavitation pressure, a directed air flow enters from the outside into a cavity between the gas-drop jet and the diffuser wall. Vortex flows resulting from the countercurrent gas flow and liquid flow force out the liquid flow from the diffuser wall to reduce the friction energy losses. Also the formation of vortex flows results in active splitting of the liquid flow, which is further intensified by clapping of the cavitation bubbles during the expansion of the flow in the diffuser. Such processes occur in case the cone angle of the diffuser defining the outlet portion 2 of the flow-through channel exceeds the cone angle of the converging tube defining the inlet portion 4 of the flow-through channel of the sprayer. Optimal apex angles of the cone forming the diffuser are between 8° and 90°. Formation of vortex flows does not occur at the apex angles exceeding 90°. At the apex angles less than 8° a gas blanket between the liquid flow and the diffuser wall is practically lacking.

Along with the proper selection of optimal taper angles for the converging tube and the diffuser, a diameter of the diffuser outlet opening is important for effective splitting of the liquid flow. It is advisable to use the diameter of the diffuser outlet opening exceeding the diameter of the cylindrical portion 3 by 4–6 times. At a lesser diameter of the diffuser outlet opening the effect of vortex flows appears only slightly upon the liquid flow and at a greater diameter the dimensions of the sprayer are substantially increased.

The sprayer having the aforementioned sizes of the flow-through channel provides for the formation of a high-velocity fine-dispersed gas-drop jet at the minimal losses of kinetic energy.

Figure 2:
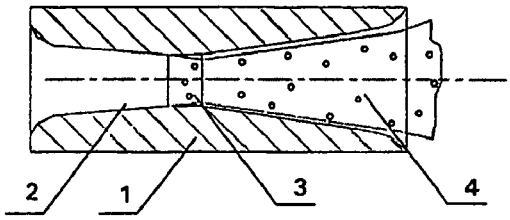
FIG. 2 is a schematic sectional view of the liquid sprayer formed in accordance with the first embodiment of the invention with rounded edges of the flow-through channel.

When the diameter of the outlet opening of the pipe union 5 is essentially greater than the diameter of the cylindrical portion 3 of the flow-through channel, use is made of a converging tube having rounded inlet edges (See FIG. 2).

Such embodiment of the sprayer allows its dimensions to be decreased with minimal losses of kinetic energy for friction and formation of vortex flows. Optimal radius of roundness of the converging tube edges is between 1 and 2.5 radius of the cylindrical portion of the flow-through channel. Increase in the radius of the rounded edges results in increased dimensions of the whole device, so the radius is preferably selected equal to the diameter of the cylindrical portion 3. With the liquid outflowing through the converging tube having rounded edges, the operational mode of the sprayer is not changed as a whole, the cavitation zones being localized in the inlet portion of the diffuser. The given operational feature intensifies cavitation in the liquid flow during acceleration thereof.

Implementation of the diffuser (outlet portion 4 of the flow-through channel) with rounded outlet edges (See FIG. 2) allows the steady state of the gas-drop jet flowing from the sprayer to be enhanced. With such embodiment of the sprayer, the jet generated is free from stationary and oscillatory deviations from a longitudinal axis of symmetry of the flow-through channel.

The radius of roundness of the diffuser outlet edges is also selected between 1 and 2.5 radius of the cylindrical portion 3 of the flow-through channel of said sprayer. An increase in the radius of roundness of the diffuser outlet edges results in the reduced effect of air vortex flows entering the diffuser on the process of splitting drops in the gas-drop jet generated. As a consequence, drop sizes in the gas-drop jet generated are increasing. On the basis of the aforementioned limitations, the radius of roundness of edges in the preferred embodiment is selected equal to the diameter of the cylindrical portion 3 of the flow-through channel.

On flowing of the accelerated liquid-gas jet through the outlet section of the diffuser having outlet edges rounded to the optimal extent, axially symmetric toroidal vortex air flows are formed in the diffuser. Such toroidal structures are axially elongated and do not give rise to disturbances in the diffuser outlet portion.

When a chamber 7 with a cylindrical channel 8 (See FIG. 3) is used in the preferred embodiment of the sprayer, the gas-drop jet is expanded and droplets are additionally split by the perforated plate 9. While advancing through the channel 8, the jet is expanded and becomes stabilized along the length of the channel which is 10 to 30 diameters of the cylindrical portion 3 of the flow-through channel of the sprayer. At the given range of lengths for the cylindrical channel 8, the velocity levelling is provided over the section of the gas-drop jet on the one hand and the required jet velocity is maintained on the other hand. Upon collision against the perforated plate 9, the size of droplets in the gas-drip jet is reduced on the average by 2–3 times.

The effect of the perforated plate 9 on the structure of the gas-drop jet generated in the flow-through channel of the sprayer is eliminated by providing free access of air from the outside to the diffuser outlet section. Such possibility is provided through selecting a total area of holes in the plate 9 in the range between 0.5 and 0.6 of the cross-sectional area of the cylindrical channel 8. An increase in the area of holes results in non-uniform drop size distribution over a section of the fine-dispersed flow generated and in the possible occurrence of separate liquid streams and gas inclusions (discontinuities in the liquid flow) on the periphery of the flow.

The optimal selection of diameters "d" of holes in the perforated plate 9 (according to the condition: $0.2<d/D<0.7$, where D is the diameter of the cylindrical portion 3) provides for time and spatially uniform splitting of the liquid flow into small droplets. The selection of hole sizes less than the optimal values results in "sticking" of liquid in the perforated plate holes due to the effect of surface tension forces. On the other hand, an increase in the diameter "d" of holes above the optimal value results in an increase in the sizes of droplets in the liquid-gas flow generated.

Tangential openings 11 (See FIG. 3) formed in the chamber 7 provide for additional vortex stabilization in the process of formation of a fine-dispersed gas-drop jet, when the liquid feed pressure is varied within a wide range (up to tenfold increase of the initial nominal level).

During operation of the sprayer the air is ejected from the outside into the cylindrical channel 8 via four tangential openings 11, which are symmetrically arranged by pairs in two cross-sectional planes of the cylindrical channel 8 of the chamber 7. The ejection is caused by the reduction of the static pressure (vacuum) at the diffuser outlet end, when the gas-drop jet is accelerated. The tangential orientation of the openings 11 formed in the chamber 7 and their symmetric arrangement in the two cross-sectional planes of the chamber 7, with the first plane extending near the diffuser outlet section and the second plane extending near the outlet section of the chamber 7, allows the ejected air flow to be uniformly swirled around the gas-drop jet. Tangential swirling of the incoming air reduces the effect of the perforated plate 9 on the flow in the cylindrical channel 8 and minimizes "sticking" of the liquid in the holes of the perforated plate 9. Also, said operational mode of the sprayer intensifies the process of intermixing the liquid drops with air across the flow section and, consequently, increases the homogeneity of drop concentration in the flow upstream of the perforated plate 9. Along with this, the possibility for occurrence of separate liquid streams affecting the formation of a homogeneous fine-dispersed gas-drop jet is eliminated.

The investigations disclosed that the optimal conditions for stabilizing a gas-drop jet are created by providing a certain ratio of the cross-sectional area of tangential openings to the total area of the effective section of the perforated plate 9, which is between 0.5 and 0.9. The number and arrangement of the tangential opening levels along the chamber 7 depend on the requirements for uniform mixing of the liquid-gas flow.

Use of a chamber 12 (See FIG. 5) in the construction of the sprayer provokes further splitting of drops in the generated cocurrent gas flow and increases the reach of a fine-dispersed gas-drops jet generated. A gas flow is generated through the outflow of gas supplied under the excessive pressure of 0.25–0.35 MPa from a high-pressure gas source 13 into an annular passage formed between the outer surface of the sprayer casing 1 and the inner surface of chamber 12. The optimal ratio of the liquid flow rate through the sprayer flow-through channel and of the gas flow rate through the annular passage of the chamber is between 90 and 25.

A narrow directed fine-dispersed gas-drop jet is finally formed, when cocurrent gas flows and a preliminary dispersed gas-drop jet are simultaneously accelerated in the nozzle of the chamber 12 composed of a converging tube 14 and a diffuser 15. While the gas-drop jet flows through the nozzle of the chamber 12, large liquid drops are split due to the action of the peripheral gas flow and additionally accelerated by said gas flow. At the initial liquid velocity of 45 m/s and at the initial gas velocity in the chamber 12 of up to 80 m/s, the average velocity of drops in the generated gas-drop jet was ~30 m/s at a distance of 3.5 m from the outlet section of the chamber nozzle. The generated gas-drop jet had sufficiently homogeneous distribution of drop sizes over the jet flow section: drop sizes in the central part of the jet were 190–200μ, in the middle annular zone 175–180μ and in the peripheral annular zone ~200μ and more.

Operation of the sprayer designed according to the second embodiment of the invention (See FIGS. 6 to 8) is performed in the manner identical to that of the first embodiment of the invention. It differs only in more optimized formation of a gas-drop jet at reduced longitudinal dimension of the sprayer. According to the second embodiment of the invention, the inlet portion 17 of the flow-through channel of said sprayer is made conoid-shaped, with radius of roundness of the side surface being not less than radius of the cylindrical portion 18 of the flow-through channel. Such construction of the inlet portion allows the losses of kinetic energy of the gas-drop jet for the formation of vortex flows in the converging tube to be decreased. The surface of the converging tube is continuously joined to the cylindrical surface of portion 18 to provide for acceleration of the liquid flow and exclude early formation of vortex flows upstream of the diffuser inlet end. Moreover, the continuous reduction in the effective section of the short conoid-shaped inlet portion 17 of the channel causes the cavitation centers to localize in the vicinity of the diffuser inlet section. As a result the fine-dispersed gas-drop jet of homogeneous concentration is generated at minimal losses of energy.

The results of investigations support the possibility of generating by means of the invention a steady-state fine-dispersed liquid flow at minimal consumption of energy. The flow generated retains the shape and size of its section at the distances of up to 10 m, with improved homogeneity of the drop concentration distribution being provided over the flow section.

INDUSTRIAL APPLICABILITY

The claimed invention may be employed in fire-prevention systems, as part of processing equipment, for burning of fuel in heat engineering and transport, as well as for humidifying the environment and spraying disinfectants and insecticides. The invention may be employed as part of fire-fighting means in the stationary and mobile units for suppressing the fires occurred in different kinds of objects: in the rooms of hospitals, libraries and museums, in the ships and planes, as well as for suppressing the sources of fire in the open air, etc.

The claimed invention is explained through the aforementioned examples of preferred embodiments, however it must be understood by those skilled in the art that in case of industrial implementation of the invention insignificant modifications can be made as compared to the illustrated examples of embodiments without substantial departing from the subject matter of the claimed invention.

What we claim:

1. A liquid sprayer comprising a casing (1) with a flow-through channel composed of sequentially joined and axially aligned an inlet portion (2) formed as a converging tube, a cylindrical portion (3) and an outlet portion (4) formed as a conical diffuser, is characterized in that the length of cylindrical portion (3) is not less than its radius but not more than its diameter, thereto the cone angle of the diffuser defining outlet portion (4) of the flow-through channel exceeding the cone angle of the converging tube defining inlet portion (2) of the flow-through channel, and outlet edges of the diffuser defining outlet portion (4) of the flow-through channel are made rounded the radius of roundness of said edges is 1–2.5 the radius of cylindrical portion (3) of the flow-through channel.

2. A liquid sprayer as claimed in claim 1 is characterized in that inlet edges of the converging tube defining inlet portion (2) of the flow-through channel are made rounded.

3. A liquid sprayer as claimed in claim 2 is characterized in that the radius of roundness of said edges is 1–2.5 the radius of cylindrical portion (3) of the flow-through channel.

4. A liquid sprayer as claimed in claim 1 is characterized in that it comprises a chamber (7) with a cylindrical channel (8) whose inlet end is connected to a diffuser outlet section, with diameter of cylindrical channel (8) of chamber (7) being at least equal to the diameter of the diffuser outlet section.

5. A liquid sprayer as claimed in claim 4 is characterized in that a diameter of cylindrical channel (8) of chamber (7) is 4–6 diameters of cylindrical portion (3) of the flow-through channel.

6. A liquid sprayer as claimed in claim 4 is characterized in that a length of cylindrical channel (8) of chamber (7) is 10–30 diameters of cylindrical portion (3) of the flow-through channel.

7. A liquid sprayer as claimed in claim 4 is characterized in that a grid or perforated plate (9) is located at the outlet section of cylindrical channel (8) of chamber (7).

8. A liquid sprayer as claimed in claim 7 is characterized in that a total cross-sectional area of holes of perforated plate (9) or grid is 0.4–0.7 the cross-sectional area of cylindrical channel (8) of chamber (7).

9. A liquid sprayer as claimed in claim 4 is characterized in that at least one tangential opening (11) is formed in the wall of chamber (7) for ejecting gas from the outside into cylindrical channel (8) of chamber (7).

10. A liquid sprayer as claimed in claim 9 is characterized in that at least four tangential openings (11) are made in the wall of chamber (7), which are symmetrically arranged by pairs in two cross-sectional planes of cylindrical channel (8) of chamber (7), the first plane extending near the diffuser outlet section and the second plane near the outlet section of chamber (7).

11. A liquid sprayer as claimed in claim 1 is characterized in that it comprises a chamber (12) arranged coaxial to casing (1), on the outside thereof, with at least one passage being formed between an outer surface of casing (1) and an inner surface of the chamber for supplying gas under pressure to the section of outlet portion (4) of the flow-through channel of said sprayer.

12. A liquid sprayer as claimed in claim 11 is characterized in that chamber (12) comprises a nozzle composed of sequentially arranged converging tube (14) and diffuser (15), with the nozzle inlet section being communicated with outlet portion (4) of the flow-through channel of said sprayer.

13. A liquid sprayer comprising a casing (16) with a flow-through channel composed of sequentially joined and axially aligned inlet portion (17) formed as a converging tube, a cylindrical portion (18) and an outlet portion (19) formed as a diffuser, is characterized in that the length of cylindrical portion (18) is not less than its radius but not more than its diameter, thereto the converging tube forming inlet portion (17) of the flow-through channel is made conoid-shaped with radius of roundness of the side surface being at least equal to the radius of cylindrical portion (18) of the flow-through channel.

14. A liquid sprayer as claimed in claim 13 is characterized in that an apex angle of a cone forming the diffuser is between 8° and 90°.

15. A liquid sprayer as claimed in claim 13 is characterized in that the conoid-shaped surface of the converging tube is joined to the surface of cylindrical portion (18) of the flow-through channel at an angle not in the excess of 2°.

16. A liquid sprayer as claimed in claim 13 is characterized in that outlet edges of the diffuser forming outlet portion (19) of the flow-through channel are made rounded.

17. A liquid sprayer as claimed in claim 16 is characterized in that a radius of roundness of diffuser outlet edges is 1–2 radius of cylindrical portion (18) of the flow-through channel.

18. A liquid sprayer as claimed in claim 13 is characterized in that it comprises a chamber (22) having a cylindrical channel (23), whose inlet is connected to the diffuser outlet section, with diameter of cylindrical channel (23) of chamber (22) being at least equal to the diameter of the diffuser outlet section.

19. A liquid sprayer as claimed in claim 18 is characterized in that a diameter of cylindrical channel (23) of chamber (22) is 4–6 diameters of cylindrical portion (18) of the flow-through channel.

20. A liquid sprayer as claimed in claim 18 is characterized in that a length of cylindrical channel (23) of chamber (22) is 10–30 diameters of cylindrical portion (18) of the flow-through channel.

21. A liquid sprayer as claimed in claim 18 is characterized in that a grid or perforated plate (24) is located in the outlet section of cylindrical channel (23) of chamber (22).

22. A liquid sprayer as claimed in claim 21 is characterized in that a total cross-sectional area of perforated plate (24) or grid is 0.4–0.7 the cross-sectional area of cylindrical channel (23) of chamber (22).

23. A liquid sprayer as claimed in claim 13 is characterized in that at least one tangential opening (26) is formed in the chamber wall for ejecting gas from the outside into cylindrical channel (23) of chamber (22).

24. A liquid sprayer as claimed in claim 23 is characterized in that at least four tangential openings (26) are symmetrically arranged in the wall of chamber (22) by pairs in two cross-sectional planes of cylindrical channel (23) of chamber (22), wherein the first plane is extending near the diffuser outlet section and the second plane is extending near the outlet section of chamber (22).

25. A liquid sprayer as claimed in claim 13 is characterized in that it comprises a chamber (27) arranged coaxial with casing (16), on the outside thereof, wherein at least one passage is formed between the outer surface of casing (16) and the inner surface of chamber (27) for supplying gas under pressure to the section of outlet portion (19) of the flow-through channel.

26. A liquid sprayer as claimed in claim 25 is characterized in that chamber (27) comprises a nozzle formed by sequentially arranged converging tube (29) and diffuser (30), wherein the nozzle inlet section is communicated with outlet portion (19) of the flow-through channel.

* * * * *